US005205346A

United States Patent [19]

Kuhn et al.

[11] Patent Number: 5,205,346

[45] Date of Patent: Apr. 27, 1993

[54] METHOD AND APPARATUS FOR COUNTERGRAVITY CASTING MOLTEN METAL

[75] Inventors: John W. Kuhn, Bristol; Richard J. Wylie, Wabash, both of Ind.

[73] Assignee: CMI International, Bristol, Ind.

[21] Appl. No.: 897,236

[22] Filed: Jun. 11, 1992

[51] Int. Cl.[5] ..... B22D 21/04; B22D 35/04; B22D 18/04

[52] U.S. Cl. ..... 164/500; 164/66.1; 164/68.1; 164/133; 164/134; 164/147.1; 164/259; 164/337

[58] Field of Search ..... 164/500, 147.1, 457, 164/113, 133, 134, 66.1, 68.1, 120, 155, 259, 337

[56] References Cited

U.S. PATENT DOCUMENTS

| | | | |
|---|---|---|---|
| 3,430,685 | 3/1969 | Drugowitsch | 164/259 X |
| 3,654,150 | 4/1972 | Eccles | 164/134 X |
| 4,585,050 | 4/1986 | Merrien et al. | 164/457 |
| 4,714,102 | 12/1987 | Koya | 164/457 |
| 4,741,381 | 5/1988 | Nishida et al. | 164/457 |
| 4,860,820 | 8/1989 | Pereira | 164/457 |
| 4,967,827 | 11/1990 | Campbell | 164/134 |
| 5,022,458 | 6/1991 | Smith | 164/457 |

FOREIGN PATENT DOCUMENTS

| | | | |
|---|---|---|---|
| 42-25549 | 12/1967 | Japan | 164/337 |
| 54-14338 | 2/1979 | Japan | 164/66.1 |
| 61-132258 | 6/1986 | Japan | 164/457 |
| 63-252667 | 10/1988 | Japan | 164/337 |
| 64-2776 | 1/1989 | Japan | 164/66.1 |
| 1052332 | 11/1983 | U.S.S.R. | 164/500 |

*Primary Examiner*—J. Reed Batten, Jr.

*Attorney, Agent, or Firm*—Reising, Ethington, Barnard, Perry & Milton

[57] ABSTRACT

A countergravity casting apparatus (10) includes a mold (12) supported above a furnace (14) containing a supply of molten metal to be cast into the mold (12). An electromagnetic pump (66) is accommodated in a casting chamber (46) of the furnace (14) and pumps the metal against gravity from the furnace (14) into the mold (12). The casting chamber (46) is enclosed by an insulating cover (40) and defines an air space over the metal in the chamber (46). A lance (64) extends through the cover (40) and delivers inert gas into the air space and purges it of outside atmospheric gases that would otherwise contaminate the metal in the chamber (46).

13 Claims, 2 Drawing Sheets

AR
PT
DPC
PLC

METHOD AND APPARATUS FOR COUNTERGRAVITY CASTING MOLTEN METAL

BACKGROUND OF THE INVENTION

1. Technical Field

This invention relates to a method and apparatus for countergravity casting molten metal in a mold using an electromagnetic pump.

2. Description Of Related Prior Art

Countergravity casting is often used for producing high quality, thin-walled castings. With all known low pressure systems, a casting mold is supported above a vessel containing a supply of molten metal and some means are provided for delivering the metal against gravity from the vessel into the mold. Low pressure countergravity casting enables a slow, tranquil fill of the mold, assuring that even the very thin sections of the casting will be fully developed.

With some systems, the delivery of metal is effectuated by pressurizing the entire supply of metal in the vessel with air or other gas. Precisely controlling the flow of metal in such systems, however, is difficult since any change is countered by the momentum of the entire metal supply. In other words, the entire supply must react to a change in flow for any portion thereof to react.

Other known low pressure systems utilize an electromagnetic pump rather than pressurized air for delivering molten aluminum metal into the mold. With such systems, the pump is typically accommodated within the vessel and is responsive to changes in input voltage for delivering only a fraction of the metal supply from the vessel into the mold. Since only a small portion of the metal supply is under pressure at any given time, metal momentum is significantly less a factor when desiring to make changes in metal flow. Consequently, rapid and frequent changes can be made to the metal flow for precisely controlling the fill of the mold.

Of those low pressure casting systems known to utilize electromagnetic pumps, the pump is most often accommodated in an open well of the vessel. The open well, however, is a source for a tremendous amount of heat loss as well as contamination of the metal from exposure to the external atmosphere. Aluminum metal both oxidizes and picks up hydrogen when exposed which, if cast into the mold, produces defects within the casting.

To account for the heat loss, these systems are known to heat the metal well above the desired casting temperature which, in turn, produces temperature differences throughout the melt. The temperature variation is harmful to the pump in that it subjects the pump to thermal cycling and shortens its life. These pumps are very costly. It also affects the viscosity and corresponding flow characteristics of the metal. This is problematic in that the characteristic output of the pump changes with changing metal viscosity. Thus, controlling the rate at which metal is pumped into the becomes more difficult.

Another problem with overheating the metal is that aluminum's affinity for hydrogen increases with increasing temperature thereby further adding to the hydrogen contamination of the metal.

One system is known to provide a cover over the well of the vessel for lessening the heat loss and is disclosed in the U.S. Pat. No. 4,967,827 to Campbell, granted Nov. 6, 1990. The cover, however, does not protect the molten metal from contamination by the external atmosphere as the environment in the space between the cover and the molten metal is not taught as being any different from that of the external atmosphere. As such, this system presents all of the problems of contamination as those with no cover.

Accordingly, there is a need in the industry for a low pressure countergravity casting system utilizing an electromagnetic pump which both insulates the molten metal from heat loss as well as protecting it against contamination from the external atmosphere.

SUMMARY OF THE INVENTION AND ADVANTAGES

An apparatus for a countergravity casting molten metal within a mold, comprises: reservoir means having a casting chamber therein for containing a supply of the molten metal; a casting mold supported above said reservoir means; electromagnetic pump means associated with said casting chamber of said reservoir means and fluidly coupled to said mold for pumping the molten metal upwardly against gravity from said reservoir means into said mold, and characterized by cover means for defining an enclosed air space over the metal in said casting chamber and inert gas purging means for supplying inert gas to the air space and thereby purging the air space of external atmospheric gasses which would otherwise react with and contaminate the molten metal in said casting chamber.

A method of casting molten metal against gravity into a casting mold is also contemplated and includes the steps of melting metal in a melting furnace; introducing the molten metal into a casting furnace; disposing an electromagnetic pump in the casting furnace; covering the casting chamber with an insulating cover and defining an enclosed air space over the metal in the chamber; supplying the enclosed space with inert gas to thereby provide an inert atmosphere to the space and purge it of any external atmospheric gasses which would otherwise react with and contaminate the metal in the chamber; and actuating the pump and pumping the metal against gravity from the casting chamber into an above-situated casting mold.

The present invention thus provides a countergravity casting system which advantageously employs an electromagnetic pump for precisely controlling the countergravity fill of the mold while at the same time insulating the metal from heat loss and providing an inert atmosphere to the molten metal to protect it against contamination from exposure to the external atmosphere.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF PREFERRED EMBODIMENT

Figure 1:
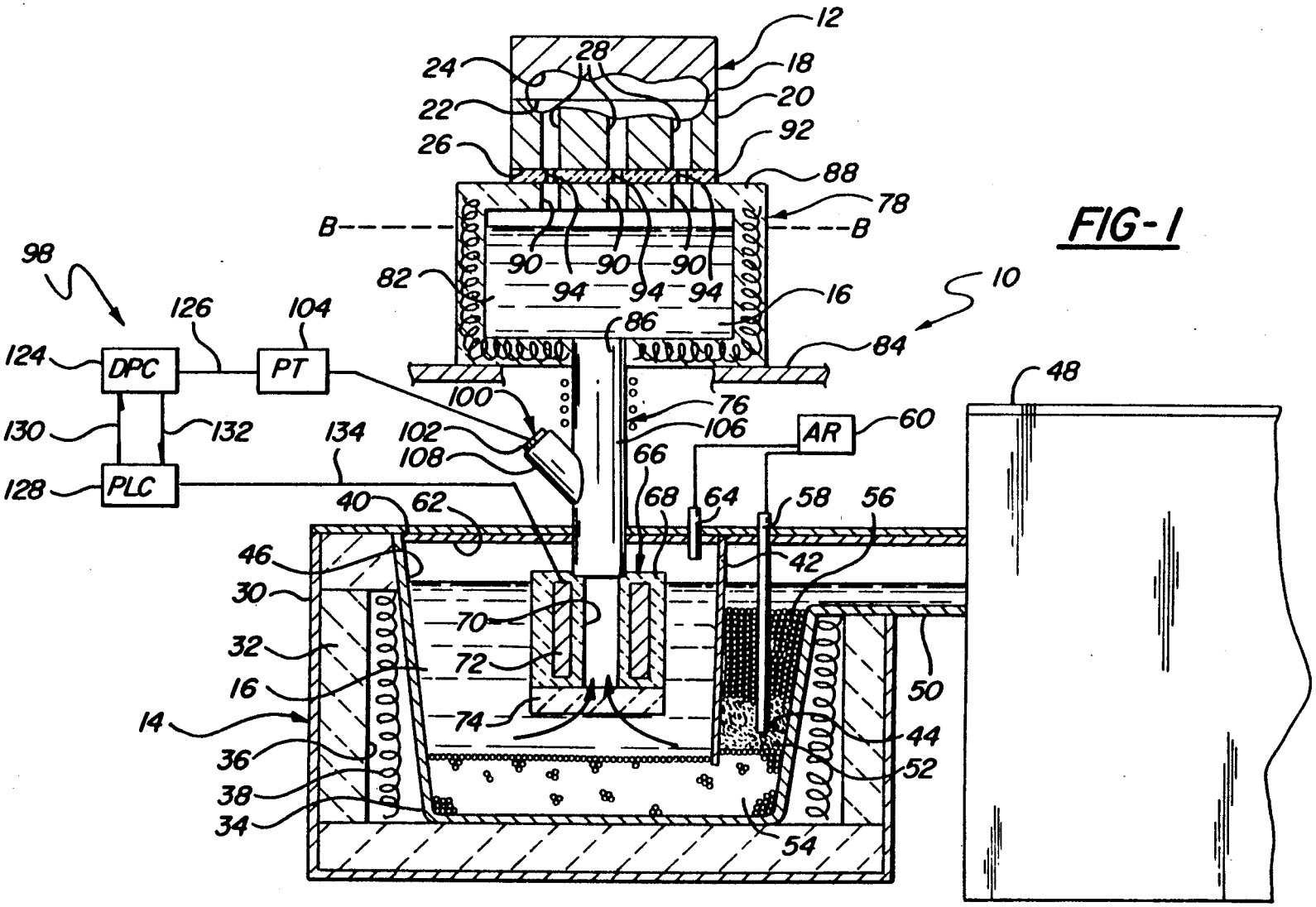
FIG. 1 is a simplified diagrammatic view of an apparatus according to the present invention.

A preferred embodiment of an apparatus constructed in accordance with the present invention is generally shown at 10 in FIG. 1.

The apparatus 10 comprises a casting mold 12 situated above a reservoir 14 containing a supply of molten metal 16, such as molten aluminum, which is to be delivered into the mold 12.

The casting mold 12 comprises an upper mold half (cope) 18 which is joined to a lower mold half (drag) 20 along parting line 22 and defining a mold cavity 24 therebetween. Extending upwardly from a bottom side 26 of the mold 12 is a plurality of inlet feed gates 28 establishing fluid communication between the mold cavity 24 and the bottom side 26 of the mold. The mold 12 is preferably fabricated of resin-bonded silica sand and according to conventional foundry mold making practice but may be constructed from other conventional foundry mold materials and according to other conventional practice. Metal dies may also be used.

The reservoir 14 is a modified 181 Alcoa filtering and degassing crucible furnace. Such a crucible furnace 14 comprises a metal outer shell 30 lined with an insulating refractory liner 32 and accommodating a crucible or vessel 34 therein. The side walls of the crucible 34 are spaced from the liner 32, which space 36 accommodates induction heating coils 38 connected to a suitable power source (not shown) for heating molten metal 16 within the crucible 34 and maintaining its temperature to within ±5° F. of a predetermined casting temperature and, more preferably, to within ±3° F. of that temperature. With aluminum-based metal, the desired casting temperature is between 1250°–1280° F.

An insulated cover 40 has been added to the furnace 14 and comprises a metal plate lined with an insulating refractory material. The cover 40 assists the heating coils 38 in maintaining the metal to within the desired temperature range.

Extending downwardly from the cover 40 and into the crucible 34 is a weir 42 which partitions the crucible 34 into separate receiving and casting chambers 44 and 46 respectively. The extended free end of the weir 42 is spaced from the bottom of the crucible 34 and provides a fluid passageway or opening between the chambers 44 and 46.

The receiving chamber 44 is coupled to a metal supply furnace 48 with a heated and insulated launder or trough 50. The metal supply furnace 48 is a commercially available gas reverb high-efficiency type furnace used for melting the metal and heating it to approximately the casting temperature before delivery to the crucible furnace 14. Molten metal from the supply furnace 48 is directed into the top of the receiving chamber 44 where it thereafter travels downwardly through the chamber 44, beneath the weir 42 and into the casting chamber 46. The receiving chamber 44 has a filter media 52 disposed therein above the fluid passage in the weir 42 and through which the molten metal 16 must pass before entering the casting chamber 46. The filter media 52 is preferably an alumina flake material supported off the bottom of the crucible 34 by a bed of ceramic beads 54 and similarly covered with another layer of ceramic beads 56.

Extending down through the cover 40 and into the filter media 52 is a lance 58 connected at its inlet side to an inert gas source 60, such as argon or nitrogen, for bubbling inert gas into the filter media 52. When the molten metal is passed through the filter media 52, any undesirable inclusions such as oxides, are trapped and filtered from the metal before it enters the casting chamber 46. Further, when casting molten aluminum metal, the filter media 52 and inert gas together filter out any hydrogen gas dissolved in the aluminum (which has a natural affinity for hydrogen) before the aluminum enters the casting chamber 46. The scavenged hydrogen attaches to the argon bubbles introduced into the filter media 52 and then rises to the surface of the melt with the argon bubbles to prevent the hydrogen from contaminating the molten metal in the casting chamber 46. Hydrogen is an undesirable component when casting aluminum since its affinity for hydrogen decreases with cooling causing the hydrogen to come out of solution in the form of bubbles during solidification and thereby produce undesirable porosity defects in the resultant cast article.

The molten metal 16 is maintained at a substantially constant level in the casting chamber 46 with there being an enclosed air space 62 between the upper surface of the metal 16 and the cover 40 overlying the chamber 46. Extending through the cover 40 and into the air space 62 is another lance 64 coupled to the same or different inert gas source 60. The lance 64 directs a positive flow of the inert gas (e.g., argon or nitrogen) into the air space 62 and purges the space 62 of any external atmospheric gases which would otherwise react with and recontaminate the metal in the casting chamber 46 with oxide inclusions and hydrogen. The inert gas thus provides an inert, nonreactive atmosphere to the filtered and degassed metal to protect it against recontamination from the external atmosphere. It is insufficient, however, for applying enough pressure to the metal in the chamber 46 to cause the metal to be delivered into the mold 12. There is essentially no differential pressure between the casting chamber 46 and the mold cavity 24 but for the positive flow of purging gas into the chamber 46 (less than 1 psi). The cover 40 does not seal the chamber 46 air tight but rather enables contaminating atmospheric gases to escape from the chamber 46 through the cover 40 and enables a positive flow of purging gas to be maintained without excessively pressurizing the chamber 46.

Pump means, and preferably an electromagnetic pump 66, is immersed in the metal contained in the casting chamber 46 of the crucible furnace 14 and is responsive to an input voltage applied thereto for pumping the molten metal 16 against gravity from the furnace 14 into the cavity 24 of the mold 12 through the bottom feed gates 28 thereof. The pump 66 has a refractory housing 68 defining a vertical channel 70 extending internally therethrough between a bottom inlet and a top outlet thereof. An electromagnet 72 is supported within the housing 68 and is responsive to the applied voltage for applying electromagnetic energy to the molten metal contained in the vertical channel 70 to force it upwardly according to the right hand motor rule. A ceramic porous filter 74 covers the inlet of the pump 66 and further filters any oxide inclusions from the metal before delivery into the mold 12. The electromagnetic pump 66 may be of any type, such as model PG-450 commercially available from CMI Novacast, Inc., 190 Kelly Street, Elk Groove Village, Ill. 60007.

The bottom inlets 28 of the mold 12 are coupled to the outlet of the electromagnetic pump 66 by a heated vertical delivery system comprising a heated refractory feed tube 76 and a heated distribution vessel 78. The distribution vessel 78 is supported above the crucible furnace 14 on support surface 84 and has heated refractory walls defining a holding chamber 82 therein. The holding chamber 82 is of appreciably less volume capacity than either the crucible furnace 14 or the metal supply furnace 48.

The feed tube 76 is connected at its bottom end to the outlet of the pump 66 and from there extends vertically upwardly and is coupled to a single bottom inlet 86 of the distribution vessel 78 for establishing fluid communication between the distribution vessel 78 and the casting chamber 46.

The mold 12 is supported above the crucible furnace 14 by a top wall 88 of the distribution vessel 78. The top wall 88 is fabricated of refractory material and formed with a plurality of distribution holes 90 therethrough corresponding in number, arrangement and approximate size to the plurality of bottom feed gates 28 of the mold 12 and in registry therewith for establishing fluid communication between the holding chamber 82 and the mold cavity 24. The particular size, number and arrangement of the feed gates 28 and holes 90 are dependent on the configuration of the cavity 24 and selected so as to deliver and distribute the molten metal directly into the cavity 24 at various locations without the need for a gating system. A refractory orifice gasket or plate 92 is disposed between the mold 12 and distribution vessel 78 and is formed with similarly registered small openings 94 therethrough and seals the mold against leakage.

To cast the molten metal 16 from the crucible furnace 14 into the casting mold 12, a controlled amount of voltage is applied to the pump 66 which in turn pumps the metal upwardly into the mold 12 with a pressure relating to the applied voltage. Increased voltage produces a corresponding increase in pressure output of the pump 66.

Figure 3:
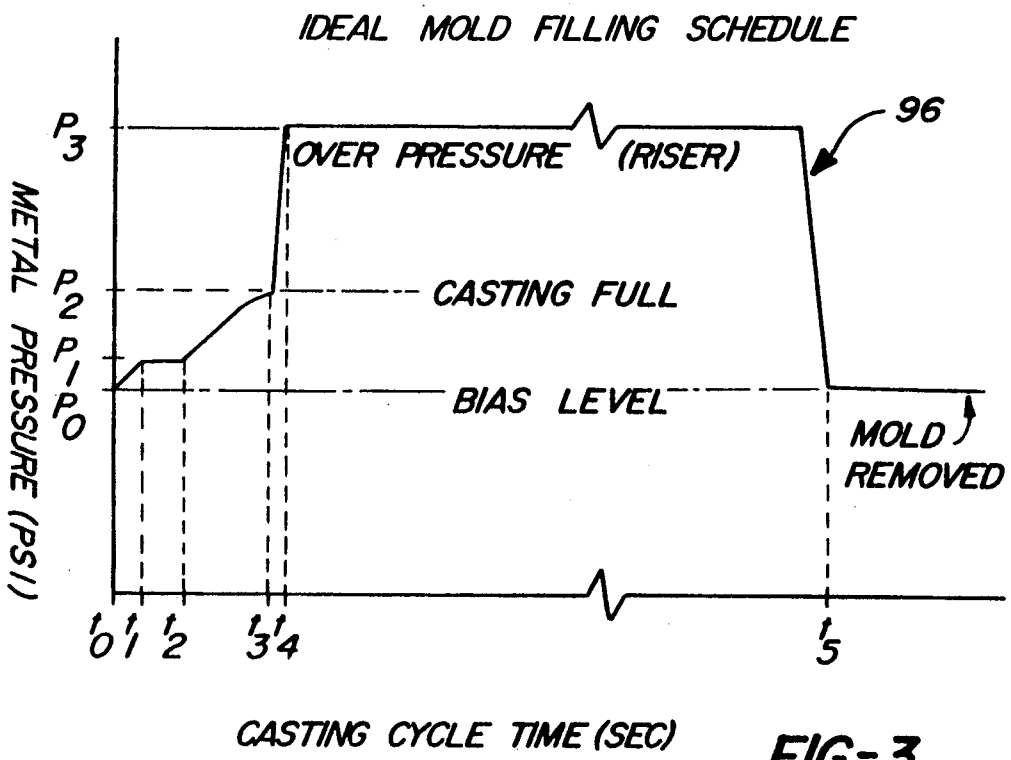
FIG. 3 is a diagrammatic view of a representative metal pressure versus casting cycle time ideal fill schedule for a mold.

For each casting mold configuration, there exists an ideal manner in which the mold cavity should be filled (i.e., a rate of filling the mold). This can be expressed in terms of the head pressure of the pumped metal (which corresponds to the height of the metal as it rises in the mold) versus casting cycle time. A representative ideal metal pressure versus casting cycle time mold filling schedule is illustrated in FIG. 3 and indicated generally by the reference numeral character 96.

In order to conform the actual mold filling rate with that of the ideal mold filling schedule 96, the apparatus 10 is provided with feedback control means 98. The control means 98 is a closed-loop system which continuously measures the actual pressure of the pumped metal during the casting cycle and controls the output of the pump 66 in order to conform the actual metal pressure with the ideal metal pressure versus casting cycle time mold filling schedule 96. In other words, the feedback control means 98 monitors the actual rate at which the mold 12 is filled through direct measurements of the actual metal pressure and then makes necessary changes to the voltage supplied to the pump 66 in order to adjust the output of the pump 66 and maintain the actual filling conditions according to the ideal mold filling schedule.

The feedback control means 98 comprises sensor means 100 for continuously sensing the actual pressure of the pumped metal and generating feedback information representative of the actual metal pressure. The sensor means 100 includes a pressure sensor 102 and a differential pressure transducer 104. The pressure sensor 102 is coupled to the feed tube 76 for directly interacting with the pumped metal and sensing changes in actual pumped metal pressure. To accommodate the sensor 102, the feed tube 76 is specially constructed with a vertical main body portion 106 establishing a generally vertical guide path for the pumped molten metal from the pump 66 to the distribution vessel 78 and a diverging branched portion 108 projecting outwardly and upwardly in relation to the main body portion 106 by about 45° and is fluidly coupled with the main body portion 106 for allowing a portion of the pumped metal to enter the branched portion of the tube 76.

Figure 2:
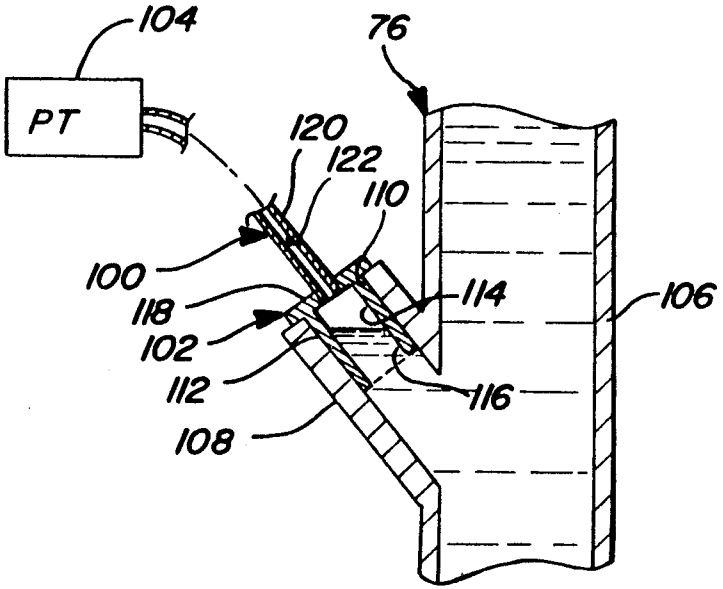
FIG. 2 is a fragmentary cross sectional view of the fill tube illustrating the construction and operation of the pressure sensor.

A portion of the pressure sensor 102 extends through and into an open distal end 110 of the branched portion 108 of the feed tube 76 for directly interacting with the molten metal therein. The extended through portion of the sensor means 100 comprises a heat-resistant titanium metal sleeve 112, the side walls of which define a chamber 114 within the sleeve 112. The extended end 116 of the sleeve 112 is open for establishing fluid communication between the chamber 114 and the fluid passageway within the feed tube 76. Since the sleeve 112 is accommodated within the branched portion 108, the extended open end 116 of the sleeve 112 is directed downwardly toward the crucible furnace 14 as shown in FIG. 2. The other end of the sleeve 112 is formed with a cap 118 which is welded or otherwise securely fastened to the branched portion 108 for sealing the distal end 110 of a branch portion 108 against metal leakage.

The pressure sensor 102 further includes a capillary tube 120 having another chamber 122 therein. The tube 120 is coupled at one of its ends to the cap 118 of the sleeve 112 with the chambers 114, 122 in fluid communication and joined at its other end to the pressure transducer 104. In a preferred construction, the volume capacity of the chamber 114 of the sleeve 112 is at least twice that of the chamber 122 of the capillary tube 120. This size relationship prevents the pumped metal from entering the capillary tube 120 and causing damage thereto.

As metal is being pumped under pressure, a portion of the pumped metal is caused to enter the open end 116 of the sleeve 112 and pressurize a pocket of air or other gaseous fluid captured within the chambers 114 and 122 of the sleeve 112 and capillary tube 120, respectively. The amount the molten metal rises in the sleeve 112 determines the amount the pocket of air within the pressure sensor 102 is pressurized and is representative of the actual metal pressure. Thus, any change in metal pressure is directly sensed by a corresponding change in the pressure of the air pocket.

The pressure transducer 104 is responsive to pressurization of the air pocket and generates feedback information in the form of voltage to a digital process controller (DPC) 124 through line 126. The feedback information is also representative of the actual pressure of the pumped metal. The DPC is a commercially available unit (Sixnet #60—IOMUXMD-RTU) which has an analog/digital interface or converter built into the unit for converting the analog feedback information into usable digital form.

The feedback control system 98 also includes a programmable logic controller (PLC) 128 coupled to both the DPC 124 and the pump 66. The PLC 128 is commercially available from Texas Instruments, model number 545. The PLC 128 is programmed with the ideal reference metal pressure versus casting cycle time mold filling schedule of FIG. 3 and provides this as set point input information to the DPC 124 through line 130 in the form of voltage.

The DPC 124 is equipped with comparator means for comparing the actual output of the pump provided by the feedback information with the desired output represented by the set point information and then acts to reduce the difference between the two to zero. The DPC 124 acts by generating difference valve information provided to the PLC 128 through line 132 in the form of voltage representative of difference between the feedback information and the set point values. Any difference reflects a diversion from the ideal mold filling schedule 96.

The PLC 128 responds to the difference value information by generating control signals to the pump 66 through line 134 at preselected control intervals for correcting the output of the pump in order to reduce the difference between actual pump output and ideal pump output to zero. The control signal information to the pump 66 is in the form of corrective voltage (i.e., increasing, decreasing, or unchanged input voltage) for increasing, decreasing or maintaining the actual pumped metal pressure according to the ideal schedule 96. The PLC 128 delivers a control signal to the pump 66 about once every 5 milliseconds.

When casting an article with the subject apparatus 10, the appropriate mold is first selected and positioned on the distribution vessel 78 with the feed gates 28 aligned with the distribution holes 90.

The PLC 128 is programmed with the ideal mold filling date schedule information of FIG. 3 which indicates that at the start of each casting cycle, the metal is at a bias level B within the distribution vessel 78, which corresponds to a metal pressure of $P_0$. Between the casting cycle times $t_0$ and $t_1$, the initial pressure is scheduled to be increased from $P_0$ to $P_1$ in order to raise the metal from the bias level B up to the inlets of the mold 12 where it then dwells for a short period from $t_1$ to $t_2$. The metal pressure is then scheduled to increase from $P_1$ to $P_2$ between the times $t_2$ to $t_3$ to completely fill mold cavity 24 with molten metal.

This filling schedule produces a slow, tranquil fill of the mold 12 and assures that even very thin sections of the mold cavity 24 are filled and that no turbulence is experienced as the metal rises in the mold 12. As shown in FIG. 3, just before the mold cavity 24 has reached the completely full mark, the rate of metal pressure increase (i.e., the mold fill rate) drops off slightly. This is to prevent hydraulic hammering of the molten metal against the upper cavity wall which might cause metal penetration into the mold, undesirable flashing at the parting line 22, or mold breakage.

At time $t_3$, the molten metal contacting the cavity walls will have solidified thereby forming an impenetrable skin or shell around the casting. The metal in the feed gate inlets 28, however, remains molten. Once the casting is full and the outer skin developed, the metal pressure is scheduled to rapidly increase from $P_2$ to $P_3$ over the time period from $t_3$ to $t_4$ in order to force additional molten metal into the mold cavity 24 to compensate for any shrinkage during solidification of the metal in the mold. The over pressure acts as a riser. This over pressure is scheduled to be maintained until the time $t_5$ at which the metal in the openings 94 of the orifice plate 92 has solidified, after which time the mold is removed and the metal pressure returned to $P_0$ (i.e., the bias level B) in preparation for the next casting.

At all times during the casting cycle, a portion of the pumped metal is present in the chamber 114 of the sleeve 112 and is continuously pressuring the air pocket confined within the sleeve 112 and capillary tube 120. As mentioned, the pressure exerted upon the air pocket is directly related to the pressure of the pumped metal. Increasing the metal pressure thus registers as an increase of pressure of the air pocket. The pressure transducer 104 detects the air pocket pressure and sends feedback information in the form of voltage to the DPC 124. In this way, the pressure sensor 102 continuously monitors and measures the actual output of the pump 66.

The DPC 124 converts the feedback information into usable digital form and makes comparisons between the actual output of the pump 66 and the desired ideal output of the pump 66 provided to the DPC 124 from the PLC 128 as set point information. From this, the DPC 124 determines whether the actual pump output deviates from the desired pump output and then acts to correct any deviation by sending the difference value information to the PLC 128 in the form of voltage. The PLC 128 then makes necessary adjustments to the input voltage to the pump 66 in order to correct the actual pump output so that it conforms with the desired ideal pump output. The corrective voltage signals from the PLC are sent to the pump 66 once every 5 milliseconds. The pressure is controlled throughout the entire casting cycle.

It will be appreciated by those skilled in the art that the ideal mold filling schedule will depend upon the geometry of the mold, the type of metal being cast, the design of the casting equipment, etc. The schedule shown in FIG. 3 is representative of a schedule for casting a cylinder block of an internal combustion engine in which $P_0=4$ psi, $P_1=4.5$ psi, $P_2=5.0$ psi, $P_3=6.0$ psi, $t_0=0$ sec, $t_1=2$ sec, $t_2=4$ sec, $t_3=14$ sec, $t_4=15$ sec and $t_5=195$ sec.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed:

1. An apparatus for countergravity casting molten metal within a mold, comprising:

reservoir means (14) having a receiving chamber (44) and a casting chamber (46) therein separated by a partition (42) for containing a supply of the molten metal;

a casting mold (12) supported above said reservoir means (14);

electromagnetic pump means (66) disposed in said casting chamber (46) and fluidly coupled to said mold (12) for pumping the molten metal upwardly against gravity from said reservoir means (14) into said mold (12);

cover means (40) for covering said chambers (44, 46) of said reservoir means (14) and defining an enclosed air space over the metal in said casting chamber (46);

filter means (52) disposed in said receiving chamber (44) for filtering impurities from the metal introduced into said receiving chamber (44) before the metal enters said casting chamber (46);

degassing means (58) associated with said receiving chamber (44) for bubbling inert gas into said filter means (52) and thereby scavenging hydrogen gas from the metal passing through said filter means (52) before entering said casting chamber (46);

and inert gas purging means (64) associated with said casting chamber (46) for supplying protective inert gas directly to the air space and thereby purging the air space of external atmospheric gases which would otherwise react with and recontaminate the molten metal present in said casting chamber (46) that was previously cleansed in said receiving chamber (44).

2. An apparatus as set forth in claim 1 further characterized by said inert gas purging means (64) comprising a lance extending through said cover means (40) into said air space, said lance (64) being coupled to an inert gas source (60) for delivering inert gas to said air space.

3. An apparatus as set forth in claim 1 further characterized by said inert gas comprising argon.

4. An apparatus as set forth in claim 1 further characterized by said inert gas comprising nitrogen.

5. An apparatus as set forth in claim 1 further characterized by said molten metal comprising aluminum.

6. An apparatus as set forth in claim 1 further characterized by said degassing means (58) comprising a lance (58) extending into said filter means (52) and coupled to a source of said inert gas.

7. An apparatus as set forth in claim 1 further characterized by said partition (42) comprising a weir extending down into said reservoir means (14) from said cover (40) for separating said casting chamber (46) from said receiving chamber (44), said weir (42) terminating short of the bottom of said reservoir means (14) for defining a fluid passage between said chambers (44), (46) and below said filter means (52) for admitting the filtered and degassed metal from said receiving chamber (44) into said casting chamber (46), said weir (42) protecting the metal in said casting chamber (46) against contamination from the untreated metal in said receiving chamber (44).

8. An apparatus as set forth in claim 1 further characterized by said filter means (52) comprising a media of alumina flake material.

9. A method of countergravity casting molten metal into a mold, comprising the steps of:

melting metal in a melting furnace (48);

introducing the molten metal into a receiving chamber (44) of a casting furnace (14);

passing the molten metal through a filter media (52) disposed within the receiving chamber (44) to remove impurities from the molten metal;

bubbling inert gas into the filter media (52) to scavenge hydrogen gas from the metal as it passes through the filter media (52);

passing the cleansed metal around a partition (32) and into a casting chamber (46) of the furnace (14);

disposing an electromagnetic pump (66) into the casting chamber (46);

covering the receiving chamber (44) and casting chamber (46) with an insulating cover (40) and defining an enclosed air space over the cleansed metal within the casting chamber (46);

introducing inert gas into the air space of the casting chamber (46) to purge it of any external atmospheric gases which would otherwise react with and recontaminate the cleansed metal in the casting chamber (46);

and actuating the pump (66) to pump the cleansed metal from the casting chamber (46) upwardly into an above-situated casting mold (12).

10. A method as set forth in claim 9 wherein the molten metal comprises aluminum-based metal.

11. A method according to claim 9, wherein the inert gas comprises argon.

12. A method according to claim 9 wherein the inert gas comprises nitrogen.

13. A method according to claim 9 including heating the metal in the casting furnace (14) and maintaining its temperature to within plus or minus 3° F. of a desired casting temperature.

* * * * *